US005808145A

United States Patent [19]

Le Coent et al.

[11] Patent Number: 5,808,145

[45] Date of Patent: Sep. 15, 1998

[54] DETERGENT-DISPERSANT ADDITIVES FOR LUBRICATING OILS OF THE SULFURIZED AND SUPERALKALIZED ALKALINE EARTH ALKYLSALICYLATE-ALKYLPHENATE TYPE

[76] Inventors: Jean-Louis Le Coent, 80, rue du general Rouelle, 76620, Le Havre; Jacques Cazin, Chemin de Bellevue, St Martin du Manoir, 76290; Thierry Triconnet, 5, La Source, Montfort sur Risle, 27290, all of France; William W. Willis, Jr., 3557 Ponderosa Trail, Pinole, Calif. 94564

[21] Appl. No.: 704,530

[22] PCT Filed: Mar. 14, 1995

[86] PCT No.: PCT/FR95/00299

§ 371 Date: Nov. 25, 1996

§ 102(e) Date: Nov. 25, 1996

[87] PCT Pub. No.: WO95/25155

PCT Pub. Date: Sep. 21, 1995

[30] Foreign Application Priority Data

Mar. 17, 1994 [FR] France ..... 94 03138

[51] Int. Cl.[6] ..... C07C 65/01

[52] U.S. Cl. ..... 562/475; 508/525

[58] Field of Search ..... 508/331, 332; 568/23, 716; 562/473, 475; C10M 159/20, 159/22

[56] References Cited

U.S. PATENT DOCUMENTS

| | | | |
|---|---|---|---|
| 4,902,436 | 2/1990 | Hori et al. | 508/332 |
| 5,030,687 | 7/1991 | Leone | 508/460 |
| 5,035,816 | 7/1991 | Leone | 508/331 |
| 5,529,705 | 6/1996 | Small et al. | 508/332 |
| 5,538,650 | 7/1996 | Goto | 508/331 |

*Primary Examiner*—Sharon Gibson
*Assistant Examiner*—Cephia D. Toomer
*Attorney, Agent, or Firm*—Ernest A. Schaal

[57] ABSTRACT

Dispersant detergent additives for lubricating oils prepared by neutralization, carboxylation, sulfurization-overalkalinization, carbonation, distillation, filtering and degassing from alkyl phenols containing 35–85% by weight of linear alkyl substituents. The process does not require, during the neutralizing phase, the presence of a third solvent, which, by forming an azeotropic mixture with water promotes the elimination of water arising from the neutralizing reaction. The additives of the invention have improved stability to hydrolysis and improved dispersion properties, improved compatibility and improved foaming properties.

3 Claims, No Drawings

DETERGENT-DISPERSANT ADDITIVES FOR LUBRICATING OILS OF THE SULFURIZED AND SUPERALKALIZED ALKALINE EARTH ALKYLSALICYLATE-ALKYLPHENATE TYPE

This application is a 371 of PCT/FR95/00299, filed Mar. 14, 1995.

The present invention relates to new detergent-dispersant additives for lubricating oils of the sulphurised and superalkalised, alkaline earth alkylsalicylate-alkylphenate type having improved properties in terms of foaming, compatibility and dispersion in oils and stability towards hydrolysis, and to a process for the preparation thereof.

It is already known from the patent U.S. Pat. No. 3,036,971, published on 29 May 1962, to prepare detergent-dispersant additives based on sulphurised alkylphenates of high basicity alkaline earth metals by sulphurisation of an alkylphenol, neutralisation of the sulphurised alkylphenol with an alkaline earth base, then superalkalisation by carbonation of the alkaline earth base dispersed in the sulphurised alkylphenate; this type of product has the disadvantage of being relatively unstable towards hydrolysis, with the formation of a precipitate of crystalline calcium carbonate, particularly if said type of product is highly superalkalised, which leads to risks of blockages in the filters of marine engines.

It is also known from the French patent 1.563.557 published on 11 Apr. 1969 to prepare detergent additives based on sulphurised calcium alkylsalicylates by carboxylation of a potassium alkylphenate, exchange with calcium chloride, then sulphurisation of the calcium alkylsalicylate obtained with sulphur in the presence of lime, a carboxylic acid and an alkylene glycol or alkylether of alkylene glycol; such a process has the disadvantage of requiring an exchange reaction.

Under these circumstances, the applicant described in French patent application 2.625.220 published on 30 Jun. 1989 a process for the preparation of superalkalised detergent-dispersant additives based on alkylphenates and alkylsalicylates, which comprises the following steps:

a) neutralisation of an alkylphenol having $C_8$ to $C_{30}$ alkyl substituents by an alkaline earth base in the presence of a $C_1$ to $C_8$ acid and of a solvent forming an azeotrope with the water of reaction at a temperature corresponding to the reflux temperature of the azeotrope;

b) distillation of the solvent;

c) carboxylation using carbon dioxide under pressure to convert the alkylphenate to alkylsalicylate;

d) sulphurisation and superalkalisation by sulphur and an alkaline earth base in the presence of glycol and a third solvent, followed by carbonation;

e) and finally filtration.

However, this process developed by the applicant and the products obtained by said process have several disadvantages.

Firstly, in the neutralisation step, the use of a solvent giving an azeotrope with water is needed to obtain a sufficient degree of conversion of alkylphenol to alkylphenate.

The carboxylation step takes place at elevated pressures generally between 5 and $15.10^5$ Pa in order to convert the alkylphenate to alkylsalicylate.

Moreover, the sulphurisation and superalkalisation step is dangerous from an industrial point of view because it gives rise to a sudden release of hydrogen sulphide which could not be controlled.

Finally, the products obtained by this former process have properties of dispersion and compatibility with lubricating oils that are inferior to those of alkylsalicylates having the same alkaline earth metal content and, in particular, exhibited poor stability towards hydrolysis, requiring frequent changes of the filters used in the lubricating circuits of marine engines.

The applicant has now found that he was able to improve substantially the performance of said additives, particularly in the tests relating to foaming, compatibility and dispersion in a new oil and in the tests of stability towards hydrolysis, by preparing them by a process comprising the following steps:

A) Neutralisation of alkylphenols containing at least 35 wt. % and at most 85 wt. % of linear alkylphenol in which the linear alkyl radical contains 12 to 40 and preferably 18 to 30 carbon atoms, in mixture with a maximum of 65 and a minimum of 15 wt. % of branched alkylphenol in which the branched alkyl radical contains 9 to 24 and preferably 12 carbon atoms, using an alkaline earth base, in the presence of at least one carboxylic acid containing from 1 to 4 carbon atoms, said neutralisation operation being carried out at a temperature of at least 215° C., the pressure in the reactor in which the neutralisation reaction is carried out being reduced gradually below atmospheric in order to remove the water of reaction, in the absence of any solvent capable of forming an azeotrope with the latter. The quantities of reagents used correspond to the following molar ratios:
   - alkaline earth base/total alkylphenol between 0.2 and 0.7 and preferably between 0.3 and 0.5,
   - total carboxylic acid/total alkylphenol between 0.01 and 0.5 and preferably between 0.03 and 0.15;

B) Carboxylation of the alkylphenate obtained in step A) in order to convert at least 22 mole % and preferably at least 25 mole % of the starting alkylphenols to alkylsalicylate (measured as salicylic acid), by the action of carbon dioxide, at a temperature between 180° and 240° C., preferably between 190° and 220° C., under a pressure which may range from atmospheric pressure to $15\times10^5$ Pa (15 bars) for a period of one to eight hours, optionally in the presence of a dilution oil (for example, 100 N) added at the beginning or at the end of step A or step B;

C) Sulphurisation and superalkalisation of the mixture of alkylphenate and alkylsalicylate obtained by elemental sulphur in the presence of an alkaline earth base, a monoalcohol having a boiling point higher than 150° C. and preferably higher than 175° C. and optionally at this stage an alkylene glycol or an alkylether of alkylene glycol at a temperature between 145° and 180° C., preferably between 150° and 160° C. The quantities of reagents used correspond to the following molar ratios:
   - sulphur/total alkylphenol between 0.3 and 1.5, and preferably between 0.8 and 1.0;
   - total alkaline earth base/total alkylphenol between 1.0 and 3.5 and preferably between 1.4 and 3.0;
   - total alkaline earth base/monoalcohol having a boiling point higher than 150° C. between 0.3 and 0.5, then, after the addition of the alkylene glycol or the alkylether thereof, if it has not already been added in a molar ratio of total alkaline earth base/alkylene glycol between 1.0 and 3.0 and preferably between 1.4 and 1.8, carbonation of the medium obtained by carbon dioxide at a temperature of 145° to 180° C. and under a pressure close to atmospheric pressure, the quantity of $CO_2$ used being between that which can be completely absorbed by the reaction medium and an excess of 30% of this quantity;

D) Removal of the alkylene glycol and the monoalcohol by distillation;

E) Filtration to remove the sediments;

F) And finally degassing in the air at a temperature between 80° and 160° C., preferably between 100° and 140° C. until the classification of the copper strip is 1A in the test according to the standard ASTM D-130 carried out for at least 15 minutes at 150° C. and preferably for 1 hour at 150° C.

According to another aspect, the present invention also relates to a detergent-dispersant additive for lubricating oil of the sulphurised and superalkalised, alkaline earth alkylsalicylate-alkylphenate type, characterised in that a) the alkyl substituents of said alkylsalicylate-alkylphenate are in a proportion of at least 35 wt. % and at most 85 wt. % of linear alkyl in which the number of carbon atoms is between 12 and 40, preferably between 18 and 30 carbon atoms, with a maximum of 65 wt. % of branched alkyl in which the number of carbon atoms is between 9 and 24 and preferably 12 carbon atoms;

b) the proportion of alkylsalicylate in the alkylsalicylate-alkylphenate mixture is at least 22 mole % and preferably at least 25 mole % and c) the molar proportion of alkaline earth base with respect to the alkylsalicylate-alkylphenate as a whole is between 1.0 and 3.5.

The additives obtained according to the present invention may have a high basicity, reflected by the BN of said additives and measured according to the standard ASTM-D2896 and which may readily reach values of 250 to 350 and even more.

It will be noted that the additives according to the invention are based on alkaline earth metals to the exclusion of any alkali metal such as, in particular, sodium and potassium.

The applicant has found that the improvement in the properties of the additives thus obtained in terms of foaming, compatibility and dispersion and stability towards hydrolysis required the use of starting alkylphenols containing at least 35 wt. % and at most 85 wt. % of alkylphenols in which the alkyl radical which contains 12 to 40 carbon atoms is linear and not branched.

In fact, it was conventional practice hitherto to use for the preparation of such additives alkylphenols in which the alkyl radical was generally a tetramer of propylene, that is, a branched dodecyl radical.

However, the use of such a branched alkylphenol, in so far as it is present in a quantity of more than 65 wt. % in the starting alkylphenol, does not make it possible to obtain additives having the improved properties according to the invention.

Branched alkylphenols obtained by reaction of phenol with a branched olefin containing 9 to 24 carbon atoms and generally originating from propylene consist of a mixture of monosubstituted isomers, the great majority of the substituents being in the para position, very few being in the ortho position and hardly any in the meta position, which makes them relatively reactive towards an alkaline earth base, since the phenol function is practically devoid of steric hindrance.

On the other hand, linear alkylphenols obtained by reaction of phenol with a linear olefin containing 12 to 40 and preferably 18 to 30 carbon atoms and originating generally from ethylene consist of a mixture of monosubstituted isomers in which the proportion of linear alkyl substituents in the ortho and para and even meta positions is much better distributed, which makes them much less reactive towards an alkaline earth base since the phenol function is much less accessible due to considerable steric hindrance due to the presence of closer and generally heavier alkyl substituents.

It is all the more surprising, under these circumstances, to be able to obtain superalkalised alkaline earth additives from mixtures of alkylphenol that may contain up to 85 wt. % of linear alkyl radical by omitting, in the neutralisation step, the third solvent forming an azeotropic mixture with water and which was considered indispensable hitherto for causing the branched, more reactive alkylphenols to react with the alkaline earth base.

The applicant achieved this by maintaining in this first neutralisation step the presence of a carboxylic acid which acts as a transfer agent for the calcium from a mineral reagent to an organic reagent and by providing harsher reaction conditions, namely a temperature of at least 215° C. and a gradual reduction in the pressure in the reactor below atmospheric so as to obtain a very low absolute pressure of at most 7,000 Pa (70 mbars) at this temperature in order to facilitate the removal of water.

The alkaline earth bases that can be used for carrying out the various steps in the preparation of the additives according to the present invention include the oxides or hydroxides of calcium, magnesium, barium or strontium and particularly those of calcium.

Within the scope of the present invention, slaked lime having the chemical formula $Ca(OH)_2$ is preferred and will be used by way of illustration in the various Examples under the name of lime.

The $C_1$ to $C_4$ carboxylic acids used in the neutralisation step include formic, acetic, propionic and butyric acid, which may be used alone or in mixture.

It is preferable to use mixtures of said acids, for example, the formic acid/acetic acid mixture, in a molar ratio of acetic acid/formic acid of between 0.01 and 5, preferably between 0.25 and 2 and quite particularly of the order of 1, as described in particular in the French patent 2 625 220, applied for on 23 Dec. 1987 by OROGIL.

Examples of alkylene glycols suitable for the sulphurisation-superalkalisation step include ethylene glycol, propylene glycol, and butylene glycol.

Finally, the monoalcohols having a boiling point higher than 150° C. to be used in this same sulphurisation-superalkalisation step include $C_6$–$C_{14}$ alkanols or cycloalkanols such as ethyl-2-hexanol, oxo alcohols, decyl alcohol, tridecyl alcohol, trimethylcyclohexanol; ethers of alkylene glycols such as butoxy-2 ethanol, butoxy-2-propanol, hexyloxy-2 ethanol and the methylethers of dipropylene glycol.

The first alkylphenol neutralisation step A) is characterised by the use of a particular alkylphenol and well-defined reaction conditions, particularly in terms of temperature and pressure.

In fact, the use of an alkylphenol containing at least 35 wt. % and possibly as much, as 85 wt. % of linear alkylphenol, particularly in which the linear alkyl radical contains a large number of carbon atoms (from 18 to 30 carbon atoms) is particularly attractive because a long linear alkyl chain promotes the compatibility and solubility of the additives in lubricating oils.

However, the presence of relatively heavy linear alkyl radicals in the alkylphenols makes the latter less reactive than branched alkylphenols, hence the need to use harsher reaction conditions to bring about their neutralisation by an alkaline earth base.

The neutralisation reaction is carried out at a temperature of at least 215° C. with a gradual reduction in pressure below atmospheric so as to reach a very low pressure of at most 7,000 Pa (70 mbars) at 215° C.

Neutralisation step A) may be carried out at a temperature of at least 220° C. with a gradual reduction in pressure below atmospheric so as to reach a very low pressure of at most 7,000 Pa (70 mbars) at 220° C.

Particularly advantageous conditions of use involve carrying out the neutralisation step A) at a temperature of at least 225° C. with a gradual reduction in pressure below atmospheric so to reach a very low pressure of at most 7,000 Pa (70 mbars;) at 225° C.

According to another embodiment, neutralisation step A) is carried out at a temperature of at least 240° C. with a gradual reduction in pressure below atmospheric so as to reach a very low pressure of at most 7,000 Pa (70 mbars) at 240° C.

At the end of this neutralisation step, the alkylphenate obtained is kept preferably for a period not exceeding 15 hours and generally between 2 and 6 hours at a temperature of at least 215° C. and at an absolute pressure of between 5,000 and $10^5$ Pa (between 0.05 and 1.0 bar), particularly between 10,000 and 20,000 Pa (between 0.1 and 0.2 bar).

In fact, under these conditions, in the presence of the given proportion of $C_1$ to C4 carboxylic acid, it is possible to obtain a sufficient degree of conversion of the alkylphenol to alkylphenate which determines the final alkaline earth metal contents of the additive and consequently its detergent-dispersant properties in oils.

Provided that operations are carried out at a sufficiently high temperature and that the pressure in the reactor is reduced gradually below atmospheric, the neutralisation reaction is carried out without the need to add in this step a third solvent forming an azeotrope with the water formed during this reaction.

The purpose of the second carboxylation step B) is to convert part of the alkylphenate to alkylsalicylate by simply bubbling carbon dioxide into the reaction medium originating from the preceding neutralisation step. It must take place under pressure in order to avoid any decarboxylation of the salicylate that forms.

This carboxylation reaction of an alkylphenate containing at least 35% of relatively inert and heavy linear alkylphenate requires heating to a temperature which must be inversely related to the pressure in the reactor. Consequently, if the pressure in the reactor is to be limited to $3.5\times10^5$ Pa (3.5 bars) at most, it is necessary to operate at a temperature equal to or greater than 190° C.

According to one variant, carboxylation step B) is carried out using carbon dioxide at a temperature equal to or greater than 200° C. under a pressure of $4\times10^5$ Pa (4 bars).

During this carboxylation step, the conversion of the alkylphenate to alkylsalicylate may involve the formation of alkylphenol which must be converted to alkylphenate during the following step.

The third step (C) of the process for the preparation of the additives according to the present invention is divided into a sulphurisation and superalkalisation reaction $C_1$ followed by a carbonation reaction $C_2$.

The sulphurisation and superalkalisation reaction $C_1$ is dangerous on an industrial scale because the addition of elemental sulphur to the reaction mixture at a temperature between 145° and 180° C. is reflected in a release of hydrogen sulphide which can be controlled only under certain conditions.

The applicant found that this reaction could be controlled after cooling the product obtained at the end of the carboxylation step to about 155° C. by adding a charge of elemental sulphur at this temperature, then gradually over a period of 1 to 2 hours,. a mixture of the alkaline earth base, a monoalcohol having a boiling point higher than 150° C. at a temperature of 150° to 160° C. and optionally alkylene glycol.

Stopping the charge of said mixture causes the release of hydrogen sulphide to stop.

By performing the sulphurisation and superalkalisation reaction in this way it is possible to incorporate about 50 mole % of sulphur caused to react in the alkylsalicylate-alkylphenate obtained, the remaining 50% being removed in the form of hydrogen sulphide.

In so far as the sulphur is used in a molar proportion of 0.5 to 1.5 or even 0.8 to 1.0 with respect to the total starting alkylphenol, this means that a molar proportion of between 0.25 and 0.75, or even between 0.4 and 0.5 is found in the sulphurised and superalkalised, alkaline earth alkylsalicylate-alkylphenate.

Although the applicant is not bound by any one scientific explanation, it may be assumed that during the process steps for the preparation of the additives according to the present invention, the principal chemical reactions are as follows:

during neutralisation:

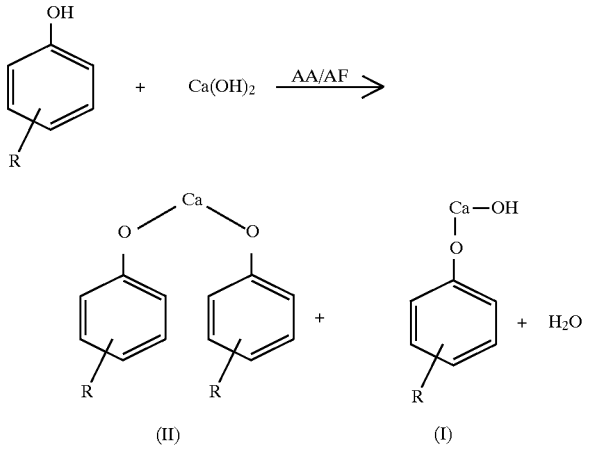

where AA/AF means a mixture of acetic acid and formic acid and where (II) is in a majority proportion and (I) is in a minority proportion.

during carboxylation:

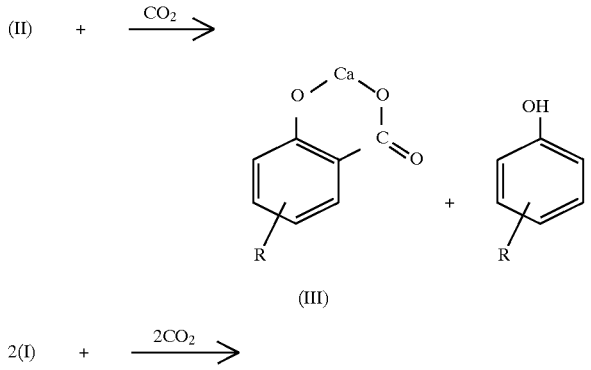

-continued

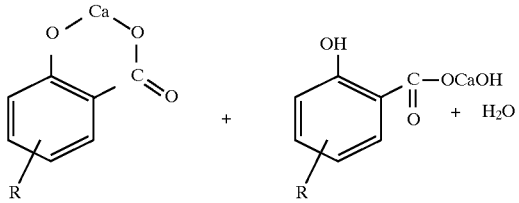

(IV)

and during sulphurisation/superalkalisation:

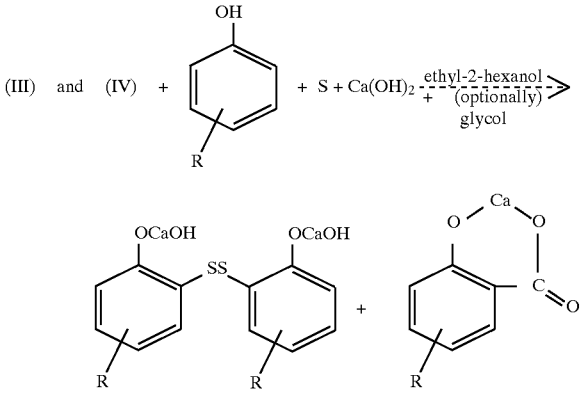

in a majority proportion

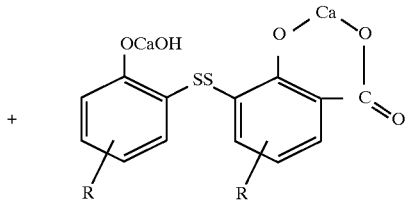

in a minority proportion

The carbonation reaction $C_2$ by bubbling carbon dioxide into the reaction medium containing an excess of alkaline earth base with respect to the alkylphenol that has reacted with the sulphur at a temperature of 145° to 180° C. requires the presence of alkylene glycol which must be added in this $C_2$ step if it was not added in $C_1$; the purpose of this $C_2$ step is to convert the additional alkaline earth base to alkylphenate and to finely divided calcium carbonate, the latter being trapped between the molecules of sulphurised alkylphenate and alkylsalicylate and thus causing superalkalisation of the additive.

The purpose of the fourth distillation stage D is to remove the alkylene glycol and the monoalcohol introduced into the reaction medium during the preceding step in order to facilitate sulphurisation, superalkalisation and carbonation of the additive according to the present invention.

The purpose of the fifth filtration step E is to remove sediments and particularly crystalline calcium carbonate which might have been formed during the preceding steps and which blocks the filters installed in lubricating oil circuits.

Finally, the sixth and last step F of degassing in air is important because it allows the additive to pass the test of stability towards hydrolysis, which is not the case with an additive produced exclusively from a branched alkylphenol such as the dodecylphenol obtained by addition of the tetramer of propylene to phenol.

The present invention also relates to the corresponding process for the preparation of said additives and lubricating oil compositions, particularly for marine engines, but also for automobiles and trains, containing a majority proportion of lubricating oil and from 2 to 20 wt. % of a detergent-dispersant additive according to the invention. Said additives may also be used in industrial applications such as hydraulic oils in proportions ranging from 0.1 to 3 wt. %.

The following examples illustrate particular embodiments of the invention and their purpose is to help the man skilled in the art to obtain additives forming the object of the present invention.

EXAMPLE NO. 1

A) Neutralisation:

A charge of 875 g of dodecylphenol (DDP) having a molecular mass of 270, (i.e. 3.24 moles) and 875 g of linear alkylphenol having a molecular mass of about 390 (i.e. 2.24 moles) is placed in a four-necked 4 litre glass reactor above which is a heat-insulated Vigreux fractionating column.

The agitator is started up and the reaction mixture is heated to 65° C. at which temperature 158 g of lime $Ca(OH)_2$ (i.e. 2.135 moles) and 19 g of a mixture (50/50 by weight) of formic acid and acetic acid are added.

The reaction medium undergoes further heating to 120° C. at which temperature the reactor is placed under a nitrogen atmosphere, then to 165° C. when the nitrogen atmosphere is stopped; distillation of water commences at this temperature.

The temperature is increased to 220° C. and the pressure is reduced gradually below atmospheric until an absolute pressure of 5,000 Pa (50 mbars) is obtained.

The reaction mixture is kept for 5 hours under the preceding conditions.

The reaction mixture is allowed to cool to 180° C., then the vacuum is broken under a nitrogen atmosphere and a sample is taken for analysis.

The total quantity of distillate obtained is about 114 $cm^3$; demixing takes place in the lower phase (62 $cm^3$ being water).

B) Carboxylation:

The product obtained in step A) is transferred to a 3.61 autoclave and heated to 180° C.

At this temperature, scavenging of the reactor with carbon dioxide ($CO_2$) is commenced and continued for 10 minutes. The amount of $CO_2$ used in this step is of the order of 20 g.

After the temperature has been raised to 200° C., the autoclave is closed leaving a very small leak and the introduction of $CO_2$ is continued so as to maintain a pressure of $3.5\times10^5$ Pa (3.5 bars) for 5 hours at 200° C.

The amount of $CO_2$ introduced is of the order of 50 g. After the autoclave has been cooled to 165° C., the pressure is restored to atmospheric and the reactor is then purged with nitrogen.

A total quantity of 1916 g of product is recovered.

C1) Sulphurisation and superalkalisation:

1114 g of the product obtained in step B) are transferred to a four-necked 4 litre glass reactor fitted with a heating system and an agitator.

After heating has been commenced, 487 g of oil 100 N and 0.2 g of antifoaming agent are introduced, with stirring.

At 155° C., a charge of 90 g of sulphur (2.81 moles) is introduced and the pressure is reduced slightly to $0.96\times10^5$ Pa (960 mbars).

A mixture of 193.6 g of glycol, 273 g of lime and 589 g (200 of which are for rinsing) of 2-ethylhexanol is prepared separately in a beaker.

Said mixture is added to the reactor in 1 hour 30 whilst keeping the temperature at 155° C. under the same slightly reduced pressure. A release of hydrogen sulphide is observed.

After the mixture has been introduced, the temperature is raised to 170° C. in 1 hour and 170 g of distillate which separates into two phases, the lower phase of which contains water and glycol, are collected in this step.

The above conditions are maintained for one hour, then the pressure is restored to atmospheric.

C2) Carbonation:

101 g of carbon dioxide are introduced at a flow rate of (about) 0.9 g/mn. The total quantity of distillate collected is 190 g, which separates into an aqueous phase of 100 g of a mixture of water and glycol and an organic phase of 90 g of 2-ethylhexanol.

D) Removal of glycol and 2-ethylhexanol

The mixture is heated to 195° C. whilst the pressure is reduced gradually below atmospheric until an absolute pressure of 5,000 Pa (50 mbars) is obtained.

The final conditions above are maintained for one hour and a sample is taken to determine the percentage of crude sediment which is 1.2%.

E) Filtration under pressure ($4.10^5$ Pa at 150° C.)

F) Degassing in the air:

The above product is degassed in the air at 110° C. for 6 hours until a 1A. copper strip is obtained in the standardised ASTM D 130 test performed under the following conditions: 15 minutes at 150° C.

The final additive obtained exhibited the following characteristics:

ANALYSES OF THE PRODUCT OBTAINED IN EXAMPLE 1

Calcium, % 9.1

Sulphur, % 2.25

BN ASTM D 2896 255

Viscosity at 100° C. 100

(in $m^2/s \times 10^6$)

EXAMPLE NO. 2

A) Neutralisation

A charge of 875 g of dedecylphenol (the alkyl chain of which is the tetramer of propylene), 875 g of linear alkylphenol (the starting olefin being a linear $C_{20}$–$C_{28}$ alpha-olefin fraction from CHEVRON CHEMICAL), 158 g of lime and 22 g of a mixture of formic acid/acetic acid (each of the two acids being present in equal weight) is placed in a 51 reactor; the latter component must be added at a temperature lower than or equal to 80° C.

Heating and agitation are commenced and the reactor is scavenged gently with nitrogen in order to expel the air in the reactor.

At 170° C., the first drops of distillate appear. At 220° C., the nitrogen feed is stopped and the reduction in pressure below atmospheric commences.

The maximum vacuum is reached after about one hour and the product is left for 4 hours under the above conditions.

The distillate collected comprises 2 layers, namely an upper layer of 60 $cm^3$ composed mainly of alkylphenol and a lower layer of 80 $cm^3$ comprising mainly water.

After the vacuum has been broken with nitrogen, the product is cooled to 200° C. and a sample is taken to determine the percentage of sediment which is 2.8%.

B. Carboxylation

The reactor is purged with $CO_2$ for 15 minutes then a $CO_2$ pressure of $3.5 \times 10^5$ Pa (3.5 bars) is applied and maintained for 5 hours under these conditions before being released.

C. Sulphurisation—superalkalisation 800 g of the above carboxylated product is drawn off into another reactor and 350 g of oil are added.

A mixture of 334 g of 2-ethylhexanol, 139 g of glycol and 196 g of lime are prepared separately in a beaker, with stirring.

Reactor heating is commenced.

At 155° C., a charge of 64 g of sulphur (2 moles) is added then, after a waiting period of 10 minutes, the above mixture is introduced, the flow rate being modified for 1 hour and a half so that the variation in temperature is between 152° and 158° C.

The temperature of the reactor is allowed to rise to 170° C.

When the mixture containing the lime has all been added, a two hour sulphurisation period commences.

The $CO_2$ is introduced in 1 hour 30 minutes at 170° C. The percentage of sediment is 1%.

D) The ethylene glycol and 2-ethylhexanol are removed by distillation. The final conditions are 1 hour at 195° C. under a pressure of 8,000 Pa (80 mbars). The percentage of sediment is 1%.

E) The product thus obtained is filtered under pressure.

F) The above product is degassed in the air at 120° C. for 6 hours. A sample is taken to verify the copper strip test according to ASTM D 130 performed under the following conditions: 15 minutes at 150° C.

The additive obtained has the following characteristics:

% Calcium 9

% Sulphur 2.34

BN D 2896 261

Salicylic acid value (in mg KOH/g) 33.6

Viscosity at 100° C.

(in $m^2/s \times 10^6$) 117

Copper strip ASTM D130 1*a*

% Sedimentation (ASTM D 2273) (vol.) 0.02

EXAMPLES NO. 3, 4, 5, 6 AND 7

STEP A): NEUTRALISATION

The following are charged in the following order to a 500 l reactor, with stirring:

87.5 kg of dodecylphenol, 87.5 kg of linear alkylphenol (the same as that used in Example no. 2)

15.8 kg of lime, 1.1 kg of formic acid, 1.1. kg of acetic acid.

The formic and acetic acids are introduced at a temperature below 80° C.

Reactor heating is commenced and maintained at 220° C. As soon as this temperature is reached, the pressure is reduced below atmospheric until a pressure of 6,000 Pa (60 mbar) is reached, which takes about 1 hour. The reactor is kept under the above conditions for 4 hours, then the vacuum is broken with carbon dioxide.

STEP B: CARBOXYLATION

The conditions are 5 hours at 200° C. under a $CO_2$ pressure of $3.5 \times 10^5$ Pa (3.5 bars).

The pressure in the reactor is released and the reactor is cooled. The product is then transferred to a storage tank. Part of this product will be used again for step C.

STEP C: SULPHURISATION - SUPERALKALISATION

Charges:

CARBOXYLATED PRODUCT: 80 kg

OIL 100 N: 35 kg

2-ETHYLHEXANOL 1:33.4 kg

2-ETHYLHEXANOL 2:8.7 kg

LIME: 19.6 kg

GLYCOL: 13.9 kg

SULPHUR: 6.5 kg $CO_2$: 7.5 kg

The carboxylated product and the oil are charged to the reactor; agitation is commenced and the reaction medium heated.

Moreover, a pre-mixture of 2-ethylhexanol 1 and glycol to which the lime is added with stirring, is prepared in a separate vessel in the proportions indicated above.

When the temperature reaches 135° C., the reactor is placed under a slightly reduced pressure (96,000 Pa, i.e. 960 mbar).

At 155° C., the pre-mixture is introduced into the reactor in about 1 hour, then the piping is rinsed with 2-ethylhexanol 2.

The reactor is then heated to 170° C. and kept for 2 hours under these conditions.

Finally, the introduction of $CO_2$ is carried out in 1 hour 30 minutes.

STEP D:

The ethylene glycol and 2-ethylhexanol are removed by distillation. The final conditions are 1 hour at 195° C. under 6,000 Pa (60 mbar).

STEP E:

The product is filtered at 150° C. under a pressure of 4 bars. The percentage of sediments is 2.4%.

STEP F:

The above product is degassed in the air at 120° C. until a 1A copper strip is obtained in the ASTM D130 test performed under the following conditions: 1 hour at 150° C.

The main variant of tests 3, 4, 5, 6 and 7 relates to the neutralisation stage.

- no. 3—heating to 220° C. then the pressure is reduced below atmospheric;
- no. 4—the reduction in pressure below atmospheric commences at 180° C.;
- no. 5—reduction in the amount of lime introduced;
- no. 6—reduction in the amount of lime introduced; the reduction in pressure below atmospheric commences at 165° C.;
- no. 7—idem no. 6, but a reflux is introduced at the top of the column leading from the reactor to the condenser in order to reduce the loss of alkylphenol.

The results of these tests are shown in Table I.

EXAMPLE NO. 8

STEP A: NEUTRALISATION

The following are charged to a 500 l reactor:

87.4 kg of dodecylphenol 87.4 kg of $C_{20}$–$C_{28}$ linear alkylphenol.

The reaction mixture is heated to 80° C. then 18 kg of lime (calcium hydroxide: $Ca(OH)_2$) are introduced; agitation is commenced and 0.53 kg of acetic acid and 0.37 kg of formic acid and 66 kg of oil 100 N are introduced.

After heating to 220° C., the pressure is reduced gradually below atmospheric until a pressure of 5,000 Pa (50 mbar) is obtained and the above conditions are maintained for five hours.

STEP B: CARBOXYLATION

This stage is carried out under the following conditions: 200° C. under a pressure of 3.5×10 Pa (3.5 bars) for a period of 7 hours.

STEP C: SULPHURISATION/SUPERALKALISATION

The process adopted is that described in Example no. 1 with the exception of the charges:

These charges are:

100 kg of product from step B, 6 kg of oil 100 N 12 kg of calcium sulphonate with a TBN of about 20

18 kg of hydrated lime 12.8 kg of glycol 5.6 kg of sulphur 6.5 kg of carbon dioxide 23 kg of 2-ethylhexanol 1

15 kg of 2-ethylhexanol 2.

The other steps, D: removal of glycol and 2-ethylhexanol, E: filtration and F: degassing, are identical to those described in Example no. 1.

The analyses obtained for the filtered and degassed product are as follows:

calcium, % 8.79 sulphur, % 2.03

BN D 2896 242 viscosity at 100° C.($m^2/s \times 10^6$) 74

% sed. (vol. %) ASTM D 2273 0.004 copper strip ASTM D 130 1A

EXAMPLES 9, 10 AND 11 INFLUENCE OF THE SULPHURISATION TEMPERATURE

Operations are carried out under the same conditions as those described in steps A and B of Example 4, and part of the product obtained at the end of carboxylation step B is then divided into three equal fractions.

All the following steps are then continued as described in this same Example 4, except that, in the first fraction (Example 9), sulphurisation is carried out at a temperature of 165° C., in a second fraction (Example 10) at a temperature of 155° C. and in the third fraction (Example 11) at a temperature of 145° C.

From an analytical point of view, as shown by the results of the analyses given in the Table below, no really significant difference is observed in respect of the final product.

| EXAMPLE No. | 9 | 10 | 11 |
|---|---|---|---|
| DEGREE OF CONVERSION (30%) (step B) | | | |
| C) SULPHURISATION/CARBONATION | | | |
| Sulphurisation temperature (°C.) | 165 | 155 | 145 |
| CHARGES (g) | | | |
| Carboxylate | 1516 | 1516 | 1516 |
| Sulphur | 87.5 | 87.5 | 87.5 |
| Lime | 288 | 288 | 288 |
| Glycol | 194 | 194 | 194 |
| 2-Ethylhexanol 1 | 465 | 465 | 465 |
| 2-Ethylhexanol 2 | 120 | 131 | 119 |
| $CO_2$ | 121 | 131 | 119 |
| OIL | 90 | 90 | 90 |
| % CRUDE SEDIMENTS | 1.8 | 1.8 | 2.0 |
| ANALYSES: | | | |

-continued

| EXAMPLE No. | 9 | 10 | 11 |
|---|---|---|---|
| % FILTERED SEDIMENTS (ASTM | 0.2 | 0.12 | 0.08 |
| D 2273) | 33 | 32 | 32 |
| Salicylic acid mg KOH/g | 9.15 | 9.2 | 9.0 |
| % Calcium | 2.3 | 2.35 | 2.3 |
| % Sulphur | 257 | 259 | 255 |
| BN D 2896 | 103 | 93 | 90 |
| Viscosity 100° C. ($m^2/s \times 10^6$) | | | |

EXAMPLE 12

Operations are carried out in an identical manner to Example 1 except that in sulphurisation/carbonation step C the lime is added first, then the glycol and ethylhexanol are added gradually.

From an analytical and performance point of view, no really significant difference is observed in respect of the final product.

COMPARISON EXAMPLE 13

The experiment forming the object of Example 7 of the applicant's French patent 2.625.220 already mentioned above is reworked.

The main characteristics of the procedure followed in this example are a mixture of alkylphenols containing 30% of linear alkylphenol, a neutralisation temperature of between 145° and 195° C., and the use of 2-ethylhexanol as azeotropic solvent.

The results obtained show that the neutralisation temperature is too low to cause the linear alkylphenols to react in a significant manner.

Similarly, the experiment forming the object of Example 1 of COSMO OIL's patent U.S. Pat. No. 4,902,436 is reworked.

Here, again, the neutralisation temperature which was 160° C. for 3 hours, did not allow the starting alkylphenols to participate significantly in the reaction with calcium oxide.

EXAMPLES 14 TO 18

A series of examples 14 to 18 was carried out in order to determine the influence of the neutralisation temperature, this being respectively 180° C. for Example 14, 200° C. for Example 15, 220° C. for Example 16, 230° C. for Example 17, and finally 240° C. for Example 18.

The operating conditions and the results obtained in each of these Examples 14 to 18, of which only Examples 16 to 18 represent the embodiments according to the present invention, are shown in Table III below.

The operating conditions for Example 16 are specified in the description below.

EXAMPLE 16

A) Neutralisation:

A charge of 875 g of dodecylphenol (DDP) having a molecular mass of 270 (i.e. 3.24 moles) and 875 g of linear alkylphenol having a molecular mass of about 390 (i.e. 2.24 moles) corresponding to a $C_{20}$–$C_{28}$ alpha-olefin fraction is placed in a four-necked 4 l glass reactor over which is placed a heat-insulated Vigreux fractionating column. The agitator is set at 350 revolutions per minute and the reaction mixture is heated to 65° C.; 139 g of lime $Ca(OH)_2$ (i.e. 1.878 moles) and 18.9 g of a mixture (50/50 by weight) of formic acid and acetic acid (i.e. 0.36 mole of this mixture) are added at this temperature.

Heating of the reaction medium is continued to 120° C. at which temperature the reactor is placed under a nitrogen atmosphere, and then to 165° C. when the nitrogen atmosphere is stopped; distillation of water commences at this temperature.

The temperature is raised to 220° C. in 1 hour, the pressure being reduced gradually below atmospheric until an absolute pressure of 5,000 Pa (50 mbars) is obtained.

The reaction mixture is kept for 3 hours under the preceding conditions.

The reaction mixture is allowed to cool to 180° C. then the vacuum is broken under a nitrogen atmosphere and a sample is taken for analysis.

The total quantity of distillate obtained is about 94 $cm^3$; demixing occurs in the lower phase (51 $cm^3$ being water). 640 g of oil 100 N are then added.

B) Carboxylation:

The product obtained in stage A) is transferred to a 3.6 l autoclave and heated to 180° C.

Scavenging of the reactor with carbon dioxide ($CO_2$) is commenced at this temperature and continued for 10 minutes. The amount of $CO_2$ used in this step is of the order of 20 g.

After the temperature has been raised to 200° C., the autoclave is closed leaving a very small leak and the introduction of $CO_2$ is continued so as to maintain a pressure of $3.5\times10^5$ Pa (3.5 bars) for 6 hours at 200° C.

The amount of $CO_2$ introduced is of the order of 50 g. After the autoclave has been cooled to 165° C., the pressure is restored to atmospheric and the reactor is then purged with nitrogen.

A total quantity of 2513 g of product is recovered.

C) Sulphurisation and superalkalisation:

1516 g of the product obtained in step B) are transferred to a four-necked 4 l glass reactor fitted with a heating system and an agitator (600 rpm).

After heating has commenced, 91 g of oil 100 N and 0.2 g of antifoaming agent are introduced, with stirring.

A charge of 90.5 g of sulphur is introduced at 110° C. and the reactor is placed under a slightly reduced pressure of $0.96\times10^5$ Pa (960 mbars). A mixture of 193.6 g of glycol, 304 g of lime and 589 g (200 of which are for rinsing) of 2-ethylhexanol are prepared separately in a beaker. Said mixture is added in 1 hour to the reactor whilst keeping the temperature at 155° C. under the same slightly reduced pressure. A release of hydrogen sulphide is observed.

After the mixture has been introduced, the temperature is raised to 170° C. in 1 hour and 170 g of distillate which separates into two phases, the lower phase of which contains water and glycol, are collected in this step.

The above conditions are maintained for 1 hour, then the pressure is restored to atmospheric.

Carbonation:

103 g of carbon dioxide are introduced at a flow rate of (about) 0.9 g/mn.

The total quantity of distillate collected is 220 $cm^3$ which separates into an aqueous phase of 90 $cm^3$ of a mixture of water and glycol, and an organic phase of 130 $cm^3$ of 2-ethylhexanol.

D) Removal of glycol and 2-ethylhexanol:

The mixture is heated to 195° C. whilst the pressure is reduced gradually below atmospheric until an absolute pressure of 5,000 Pa (50 mbars) is obtained.

The final conditions above are maintained for one hour and a sample is taken to determine the percentage of crude sediment which is 1.6%.

E) Filtration under pressure ($4.10^5$ Pa at 150° C.)

A metal cloth filter and a filtration additive are used.

F) Degassing in the air:

The above product is degassed in the air at 110° C. for 16 hours until a 1A copper strip is obtained in the standardised ASTM D130 test performed under the following conditions: 60 minutes at 150° C.

The final additive obtained exhibited the following characteristics:

ANALYSES OF THE PRODUCT OBTAINED IN EXAMPLE 16

Calcium, % 9.1

Sulphur, % 2.4

TBN ASTM D 2896 254

Viscosity at 100° C. ($m^2/s \times 10^6$) 87

Salicylic acid value 26 mg KOH/g

EXAMPLES 19 TO 22

Another series of experiments was also carried out according to Examples 19 to 22, the aim of which was to determine the influence of the relative proportion of the linear alkylphenols in the starting mixture of alkylphenols.

This proportion was 0% in Example 19, 20% in Example 20, 80% in Example 21 and 100% in Example 22. Only Examples 16 to 21 form part of the invention.

The operating conditions were the same as those used in Example 16 described above, in which the relative proportion of alkylphenols in the starting mixture of alkylphenols was, it may be recalled, 50 wt. %.

These conditions and the results obtained are shown in Table III below.

DESCRIPTION OF THE PERFORMANCE TESTS

1. STABILITY TOWARDS HYDROLYSIS: MAO 29

This method is drawn from the modified ASTM D 2619 method. Its purpose is to study the sensitivity to water of an oil and it is applicable to marine oils.

The method involves introducing a sample of oil to which demineralised water has been added into a bottle and agitating it in a thermostated oven. At the end of the test, the sample is dried, filtered and analysed. The stability towards hydrolysis is expressed by: the presence or absence of crystalline carbonate, characterised by IR spectrometry. The results are classified as "GOOD" in the absence of crystalline carbonate and "POOR" if the latter is present.

2. DISPERSION MAO 60A:

The purpose of this method is to evaluate the dispersive properties of an oil or an additive and to predict its level of performance (deposits, sludge) in comparison with a reference oil.

It is generally applicable to vehicular and marine engine oils.

According to this method, the dispersive power of the oil is obtained by carrying out paper chromatography on a mixture of oil to be tested and artificial sludge under the following conditions:

Spot no. 1: ambient temperature without water

Spot no. 2: 10 mn at 200° C. without water

Spot no. 3: 10 mn at 250° C. with water

Spot no. 4: ambient temperature with water

Spot no. 5: 1 mn at 200° C. with water

Spot no. 6: 10 mn at 200° C. with water.

The spots are observed after being left for 48 h, manually or using the CCD photometer.

The diffusion diameter (d) of the mixture and the diffusion diameter (D) of the oil alone is measured on each spot, and the ratio $d/D \times 100$ is calculated.

The dispersive power of the oil is obtained by comparing the sum of the 6 spots with the value found for one of the reference oils which will have to be tested in the same measurement series.

The addition of the ratios $d/D \times 100$ under the six conditions listed above corresponds to a maximum dispersive power of 600, corresponding to an ideal dispersion of 100% under all the conditions. In the results of this test, the higher the figure, the better the dispersive power of the oil.

3. COMPATIBILITY MAO 25

The purpose of this method is to evaluate the appearance and storage stability of the additives and of the corresponding oils containing them.

This method is applicable to additives for lubricants.

In this method, the additive and the corresponding oil containing it are stored simultaneously at ambient temperature and at elevated temperature for a defined period.

The appearance of the products is evaluated before and after storage and the results are classified as "GOOD" or "POOR" according to whether or not a single phase is maintained without deposits due to sedimentation.

4. FOAMING

The method used to determine whether a given compound gives rise to foaming is the standardised ASTM-D 892 method in which the lower the figure, the better the product.

TABLE I

| EXAMPLE NO. | 3 | 4 | 5 | 6 | 7 |
|---|---|---|---|---|---|
| CHARGES (kg) | | | | | |
| A) NEUTRALISATION | | | | | |
| Dodecylphenol | 87.5 | 87.5 | 87.5 | 87.5 | 87.5 |
| Alkylphenol, linear | 87.5 | 87.5 | 87.5 | 87.5 | 87.5 |
| Lime | 15.8 | 15.8 | 13.9 | 13.9 | 13.9 |
| Formic acid | 1.1 | 1.1 | 0.95 | 0.95 | 0.95 |
| Acetic acid | 1.1 | 1.1 | 0.95 | 0.95 | 0.95 |
| LIME/ALKYLPHENOL (MOLE) | 0.39 | 0.39 | 0.34 | 0.34 | 0.34 |
| DISTILLATE (liters) | | | | | |
| Water | 5.25 | 5.75 | 5.0 | 5.0 | 6.75 |
| Organic phase | 8.0 | 8.0 | 9.5 | 13.0 | 2.0 |
| % Sed. | 3.2 | 3.2 | 1.3 | 2.0 | 3.2 |
| BN D 664 | 113.2 | 111.1 | 99.2 | 98 | 104.2 |

TABLE I-continued

| EXAMPLE NO. | 3 | 4 | 5 | 6 | 7 |
|---|---|---|---|---|---|
| B) CARBOXYLATION | | | | | |
| Temperature (°C.) | 200 | 200 | 200 | 200 | 200 |
| Pressure (bar) | 3.7 | 3.5 | 3.6 | 3.6 | 3.5 |
| Time (hours) | 5 | 5 | 5 | 5 | 5 |
| Degree of conversion (%) | 29.1 | 25.0 | 27.1 | 27.6 | 28.7 |
| % Sediments | 3.2 | 3.2 | 1.2 | 1.6 | 2 |
| STEP C: SULPHURISATION/CARBONATION CHARGES (kg) | | | | | |
| Carboxylate | 80 | 80 | 80 | 80 | 80 |
| Sulphur | 6.5 | 6.5 | 6.5 | 6.5 | 6.5 |
| Lime | 19.6 | 19.6 | 19.6 | 19.6 | 19.6 |
| Glycol 1 | 13.9 | 13.9 | 13.9 | 13.9 | 13.9 |
| 2-Ethylhexanol 1 | 33.6 | 33.6 | 33.6 | 33.6 | 33.6 |
| 2-Ethylhexanol 2 | 8.7 | 8.7 | 8.7 | 8.7 | 8.7 |
| $CO_2$ | 7.5 | 7.0 | 7.0 | 6.6 | 6.6 |
| Oil 100N | 35 | 35 | 35 | 35 | 35 |
| % Crude sed. | 1 | 1.4 | 0.6 | 1.0 | 1.0 |
| ANALYSES OF FINAL PRODUCT | | | | | |
| % Filtered sediment | 0.012 | 0.048 | 0.04 | 0.08 | 0.024 |
| Salicylic acid (mg KOH/g) | 33.6 | 28.0 | 32.0 | 26.5 | 28.6 |
| Calcium, % | 8.98 | 9.13 | 8.95 | 8.67 | 8.59 |
| Sulphur, % | 2.34 | 2.48 | 2.61 | 2.40 | 2.39 |
| BN D 2896 | 252 | 256 | 253 | 240 | 242 |
| Viscosity 100° C. (cSt) | 117 | 125 | 125 | 117 | 108 |
| Stability MAO 29 | GOOD | GOOD | GOOD | GOOD | GOOD |
| Dispersion MAO 60A | 335 | 331 | 329 | 317 | 314 |

TABLE II

| Example no. | 8 | 9 | 10 | 11 | 12 | 13 |
|---|---|---|---|---|---|---|
| Stability MAO 29 | Good | Good | Good | Good | Good | Poor |
| Dispersion MAO 60A | 330 | 333 | 333 | 333 | 333 | 335 |
| Compatibility MAO 25 | Good | Good | Good | Good | Good | Poor |

TABLE III

| Example no. | 14 | 15 | 16 | 17 | 18 | 19 | 20 | 16 | 21 | 22 |
|---|---|---|---|---|---|---|---|---|---|---|
| Alkylphenol (linear/linear + branched × 100) | 50 | 50 | 50 | 50 | 50 | 0 | 20 | 50 | 80 | 100 |
| Neutralisation temperature (°C.) | 180 | 200 | 220 | 230 | 240 | 220 | 220 | 220 | 220 | 220 |
| STEP A: NEUTRALISATION (charges g) | | | | | | | | | | |
| Dodecylphenol | 875 | 875 | 875 | 875 | 875 | 1750 | 1400 | 875 | 350 | 0 |
| Linear alkylphenol | 875 | 875 | 875 | 875 | 875 | 0 | 350 | 875 | 1400 | 1750 |
| Lime | 139 | 139 | 139 | 139 | 139 | 163.1 | 152.7 | 139 | 122.5 | 112.9 |
| Formic acid (AF) | 9.45 | 9.45 | 9.45 | 9.45 | 9.45 | 11.1 | 10.3 | 9.45 | 8.2 | 7.75 |
| Acetic acid (AA) | 9.45 | 9.45 | 9.45 | 9.45 | 9.45 | 11.1 | 10.3 | 9.45 | 8.2 | 7.75 |
| Lime/alkylphenols (mole) | 0.34 | 0.34 | 0.34 | 0.34 | 0.34 | 0.34 | 0.34 | 0.34 | 0.34 | 0.34 |
| AA-AF/alkylphenols (mole) | 0.065 | 0.065 | 0.065 | 0.065 | 0.065 | 0.065 | 0.065 | 0.065 | 0.065 | 0.065 |
| Distillate (ml) | | | | | | | | | | |
| Water | 25 | 30 | 45 | 52 | 53 | 64 | 58 | 45 | 26 | 9 |
| Organic phase | 9 | 24 | 39 | 40 | 41 | 78 | 49 | 39 | 18 | 10 |
| % Sed. (% by vol) | 8 | 3.6 | 2 | 0.8 | 1 | 0.4 | 0.6 | 2 | 6 | 9 |
| BN D 2896 | 51 | 93 | 103 | 106 | 109 | 139 | 109 | 103 | 60 | 13 |
| STEP B: CARBOXYLATION (Charges g) | | | | | | | | | | |
| Oil | 640 | 640 | 640 | 640 | 640 | 640 | 640 | 640 | 640 | 640 |
| Temperature (°C.) | 200 | 200 | 200 | 200 | 200 | 200 | 200 | 200 | 200 | 200 |
| Pressure ($10^5$ Pa) | 3.5 | 3.5 | 3.5 | 3.5 | 3.5 | 3.5 | 3.5 | 3.5 | 3.5 | 3.5 |

TABLE III-continued

| Example no. | 14 | 15 | 16 | 17 | 18 | 19 | 20 | 16 | 21 | 22 |
|---|---|---|---|---|---|---|---|---|---|---|
| Time (hours) | 6 | 6 | 6 | 6 | 6 | 6 | 6 | 6 | 6 | 6 |
| Degree of conversion | 10 | 21 | 24 | 26 | 28 | 28 | 26 | 24 | 15 | 4 |
| Salicylic acid value mg/KOH/g | 12 | 23 | 26 | 29 | 31 | 36 | 31 | 26 | 14 | 4 |
| Sed. (% by vol) | 8 | 2 | 1.8 | 0.8 | 1 | 0.4 | 0.4 | 1.8 | 6 | 8 |
| BN D 2896 | 36 | 65 | 75 | 78 | 78 | 94 | 83 | 75 | 49 | 9 |
| STEP C: SULPHURISATION/ CARBONATION (Charges, g) | | | | | | | | | | |
| Carboxylate | 1516 | 1516 | 1516 | 1516 | 1516 | 1516 | 1516 | 1516 | 1516 | 1516 |
| Sulphur | 90.5 | 90.5 | 90.5 | 90.5 | 90.5 | 107.8 | 100.3 | 90.5 | 80.4 | 73.2 |
| Lime | 304 | 304 | 304 | 304 | 304 | 304 | 304 | 304 | 304 | 304 |
| Glycol | 193.6 | 193.6 | 193.6 | 193.6 | 193.6 | 193.6 | 193.6 | 193.6 | 193.6 | 193.6 |
| 2-Ethylhexanol | 589 | 589 | 589 | 589 | 589 | 589 | 589 | 589 | 589 | 589 |
| Water | 11 | 11 | 11 | 11 | 11 | 11 | 11 | 11 | 11 | 11 |
| Oil 100N | 91 | 91 | 91 | 91 | 91 | 91 | 91 | 91 | 91 | 91 |
| Antifoaming agent | 0.2 | 0.2 | 0.2 | 0.2 | 0.2 | 0.2 | 0.2 | 0.2 | 0.2 | 0.2 |
| $CO_2$ | 103 | 120 | 103 | 111 | 116 | 118 | 125 | 103 | 118.5 | 100 |
| % Crude sed. | 6 | 2 | 1.6 | 1 | 1 | 1.2 | 1.2 | 1.6 | 3.2 | 10 |
| Rate of filtration kg/h/m$^2$ | 65 | 75 | 350 | 340 | 350 | 80 | 150 | 350 | 17 | 10 |
| ANALYSES OF FINAL PROD. | | | | | | | | | | |
| % filtered sed. | 0.4 | 0.18 | 0.08 | 0.08 | 0.08 | 0.08 | 0.08 | 0.08 | 0.01 | 0.12 |
| Salicylic acid value (mgKOH/g) | 17 | 24 | 26 | 29 | 30 | 34 | 30 | 26 | 19 | 7 |
| Calcium, % | 8.9 | 9.1 | 9.1 | 9.1 | 9.2 | 9.65 | 9.4 | 9.0 | 8.7 | 7.75 |
| Sulphur, % | 2.6 | 2.65 | 2.4 | 2.7 | 2.6 | 2.9 | 3.0 | 2.4 | 2.3 | 2.0 |
| BN D 2896 | 247 | 250 | 250 | 250 | 254 | 270 | 260 | 250 | 240 | 213 |
| Copper strip (ASTM D 130) | 1A | 1A | 1A | 1A | 1A | 1A | 1A | 1A | 1A | 1A |
| Viscosity at 100° C. (m/S × 10$^6$) | 77 | 82 | 87 | 80 | 110 | 590 | 188 | 87 | 86 | 54 |
| TBN 250 | | | | | | 220 | 129 | 87 | — | — |
| Sulphur/alkylphenol (mole) | 0.85 | 0.85 | 0.85 | 0.85 | 0.85 | 0.85 | 0.85 | 0.85 | 0.85 | 0.85 |
| Colour ASTM D1500 | <5DD | <4.5DD | <4DD | <5DD | <5DD | <3DD | <4DD | <4DD | <5.5DD | <7DD |
| Stability MAO 29 | Poor | Poor | Good | Good | Good | Poor | Poor | Good | Good | Poor |
| Dispersion MAO 60A | 320 | 330 | 333 | 336 | 338 | 295 | 311 | 333 | 337 | 318 |
| Compatibility MAO 25 | Good | Good | Good | Good | Good | Poor | Poor | Good | Good | Good |
| Foaming D 892 SEQ 1 | 440-/180 | 200/20 | 130-/10 | 130-/10 | 140-/10 | 750-/650 | 530-/420 | 130-/10 | 30/0 | 460-/220 |
| SEQ 11 | 500/0 | 300/0 | 250/0 | 200/0 | 190-/07 | 720-/10 | 410/0 | 250/0 | 80/0 | 600/0 |
| SEQ 111 | 350/30 | 220/30 | 150/0 | 180/0 | 210/0 | 600-/460 | 580-/370 | 150/0 | 45/0 | 400-/60 |

On reading the results obtained in Examples 14 to 18 intended to measure the influence of the neutralisation temperature, the following comments may be made.

It appears that the salicylate content expressed in the form of the salicylic acid value at the end of the carboxylation step B increases with the neutralisation temperature to give the following respective results: 12, 23, 26, 29, and 31 (mg KOH/g product).

Moreover, it is clearly apparent that the neutralisation temperature range (145° C.–195° C.) used in the above-mentioned French patent 2.625.220 is plainly insufficient for the neutralisation of the linear alkylphenol by lime. This is revealed by the percentage of crude sediment (a figure which is a measure of the incorporation of lime) and by whether the product passes or fails the test of stability towards hydrolysis, as the table below shows:

| Example no. | 14 | 15 | 16 | 17 | 18 |
|---|---|---|---|---|---|
| Neutralisation temperature | 180° C. | 200° C. | 220° C. | 230° C. | 240° C. |
| Sediment, vol. % (end of neutralisation step) | 8 | 3.6 | 2 | 0.8 | 1 |
| Stability towards hydrolysis MAO 29 | Poor | Poor | Good | Good | Good |

It should also be noted that foaming of the finished product falls when the neutralisation temperature rises, which can be explained by the much greater reactivity of the linear alkylphenols at high temperature and it is known in a general manner that linear product s produce less foaming than branched products. Moreover, infra-red spectroscopy reveals a fall in the ortho-alkylphenol content (originating mainly from the linear product) when the neutralisation temperature increases.

Moreover, on reading the results obtained in Examples 19, 20, 16, 21, and 22, the following comments may be made.

In the Examples in question, only the proportion of linear alkylphenols varied in the starting mixture, which comprised linear alkylphenols and/or branched alkylphenols, as the Table below shows:

| Example no. | 19 | 20 | 16 | 21 | 22 |
|---|---|---|---|---|---|
| Lin. alkylphenol × 100 by wt. | 0 | 20 | 50 | 80 | 100 |
| Alkylphenol (lin. + br.) in moles | 0 | 14.7 | 40.9 | 73.5 | 100 |

Lin. = linear
Br. = branched

The other parameters that were held constant in these Examples are:

a) in the neutralisation step (A):
the total quantity by weight of branched alkylphenol and linear alkylphenol
the quantity of dilution oil the molar ratio:

$$\frac{\text{Acetic acid + formic acid}}{\text{Alkylphenol}}$$

and the molar ratio:

$$\frac{\text{Lime}}{\text{Alkylphenol}}$$

b) in the carboxylation step (B): the $CO_2$ pressure and the other operating conditions c) in the sulphurisation and superalkalisation step (C): the charges of the various reagents and the operating conditions.

The aim pursued in the selection of these various parameters for Examples 19, 20, 16, 21, and 22 was to obtain a satisfactory product in terms of the following four performance tests:

stability towards hydrolysis MAO 29 dispersion in new oils MAO 60A; the higher the figure, the better the product.

compatibility MAO 25 (pass=good, or fail=poor)

foaming ASTM D 892—the lower the figure, the better the product.

The results obtained in the said Examples may be summarised in the Table below:

The salicylate content expressed in the form of salicylic acid mg KOH/g product in the final product.

The results above were partly to be expected because the branched alkylphenol with a shorter and hence more reactive chain is composed in the majority of 86% para isomer and 8% ortho isomer, whilst the linear alkylphenol is composed of only 45% para isomer and 55% ortho isomer. Neutralisation of the ortho isomer is much more difficult because of steric hindrance.

On the other hand, an unexpected improvement in the stability towards hydrolysis MAO 29 and compatibility MAO 25 is observed when the linear alkylphenol content increases, and an improvement in foaming and dispersion MAO 60A when the relative starting proportion changes from 0 to 80% of linear alkylphenols.

Example 20, in which the proportion of linear alkylphenol in the starting mixture of alkylphenols was only 20% by weight is not able to provide satisfactory results in the tests of stability towards hydrolysis MAO 29 and compatibility MAO 25.

It was established in complementary tests that the minimum proportion of linear alkylphenol in the starting mixture of alkylphenols must be at least 35 wt. % in order to obtain satisfactory results in all the tests featuring in the preceding Table and, in particular, the tests of stability towards hydrolysis MAO 29 and compatibility MAO 25.

Moreover, another quite surprising observation is that the chemical mixture of 50/50 by weight linear and branched alkylphenols (Example 16), when compared with the physical mixture:

| Example no. | 19 | 20 | 16 | 21 | 22 | $\frac{19 + 22}{2}$ |
|---|---|---|---|---|---|---|
| Linear AP | 0 | 20 | 50 | 80 | 100 | 50 |
| (lin. + br.) AP × 100 (wt.) | | | | | | |
| Neutralisation | | | | | | |
| BN D 2896 | 139 | 109 | 103 | 60 | 13 | 76 |
| Sed. (% vol.) | 0.4 | 0.6 | 2 | 6 | 9 | 4.7 |
| Distilled water (ml) | 64 | 58 | 45 | 26 | 9 | 36.5 |
| Final product: salicylic acid value (mg KOH/g) | 34 | 30 | 26 | 19 | 7 | 20.5 |
| Results of tests | | | | | | |
| Stability towards hydrolysis MAO 29 | poor | poor | good | good | poor | poor |
| Dispersion MAO 60A | 295 | 311 | 333 | 337 | 318 | 309 |
| Compatibility MAO 25 | poor | poor | good | good | good | poor |
| Foaming D892 SEQ I | 750-/650 | 530-/420 | 130-/10 | 30/0 | 460-/220 | 550/180 |
| SEQ II | 720-/10 | 410/0 | 250/0 | 80/0 | 600/0 | — |
| SEQ III | 600-/460 | 580-/370 | 150/0 | 45/0 | 400-/60 | — |

AP = alkylphenol
lin. = linear
br. = branched

We note first that the neutralisation reaction is much more complete with branched alkylphenols than with linear alkylphenols, which is confirmed by the following 4 analyses.

The BN ASTM D 2896 which, after removal of the unreacted lime by filtration, is a measure of the basicity of the medium.

The percentage of sediment by volume, that is, the unreacted lime.

The quantity of water collected which originates from the acid-base reaction: (alkylphenol+lime).

$$\frac{\text{100\% branched alkylphenol (Ex. 19) + 100\% linear alkylphenol (Ex. 22)}}{2}$$

has an unexpected analytical behaviour, the results being distinctly better, as shown by the results summarised in the Table below:

| In the neutralisation stage | | |
|---|---|---|
| Examples | 16 | (19 + 22)/2 |
| BN | 103 | 76 |
| % Sed. | 2 | 4.7 |
| Distilled water (ml) | 45 | 36.5 |
| Final product: Salicylic acid value (mg KOH/g) | 26 | 20.5 |

These performances of the 50/50 chemical mixture are particularly unexpected in view of the fact that the physical mixture fails the tests of compatibility and stability towards hydrolysis, whereas the chemical mixture (Example 16) passes them. Moreover, in the foaming and dispersion tests, an unexpected phenomenon is observed: the results improve when the linear alkylphenol content rises, and deteriorate perceptibly in products containing 100% linear alkylphenol. It must therefore be assumed that there is a synergy between the simultaneous presence of linear alkylphenols and branched alkylphenols in the neutralisation stage and in respect of the performances of the finished products.

Although the applicant is not keen to be bound by any one explanation, he puts forward the following explanation for the synergy between linear alkylphenol and branched alkylphenol.

During the neutralisation step, the neutralisation of the linear alkylphenol is poor for the following reasons: low reactivity due to the length of the chain and the predominant presence of ortho isomer; moreover, due to its high molecular mass, the effect of entrainment of the water of reaction is poor. In contrast, the introduction of a branched alkylphenol into the medium improves the degree of conversion of the linear alkylphenol to alkylphenate for the following reasons:

The lime reacts firstly with a branched alkylphenol R—Ø—OH leading to the following product (I):

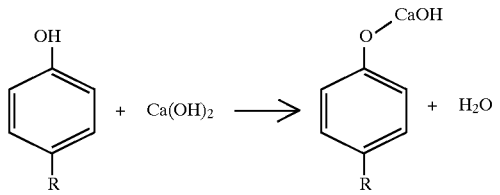

(I)

which, being more basic than lime in an organic medium, allows the neutralisation of a second mole of alkylphenol R'—Ø—OH which may be linear.

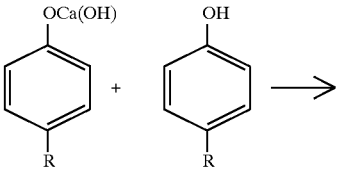

-continued

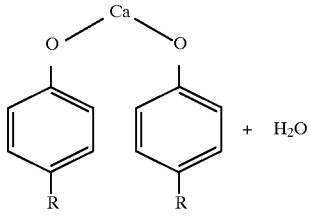

(II)

Moreover, the relative volatility of the branched alkylphenol at this temperature facilitates the loss of water.

Another proof of the synergistic effect due to the presence of a mixture of branched alkylphenol and linear alkylphenol and observed during the neutralisation step with lime is the BN ASTM D 2896 which is a measure of the incorporation of lime, since this analysis is carried out after filtration, that is, removal of unreacted lime.

The Table below gives the BN (ASTM D2896) obtained on the one hand for the pure branched alkylphenol and then for the pure linear alkylphenol, and on the other hand for mixtures of 20/80, 50/50 and 80/20 by weight.

We observe that the more the linear proportion increases, the greater the discrepancy between the actual BN and the theoretical BN (20/80, 50/50 and 80/20).

| Example no. | 19 | 20 | 16 | 21 | 22 |
|---|---|---|---|---|---|
| Linear AP in % | 0 | 20 | 50 | 80 | 100 |
| Branched AP in % | 100 | 80 | 50 | 20 | 0 |
| Actual BN, neutralisation stage | 139 | 109 | 103 | 60 | 13 |
| Theoretical BN | 139* | 113.8 | 76 | 38.2 | 13* |
| Theoretical BN/ actual BN | 1 | 1.04 | 0.74 | 0.64 | 1 |

*Pure products

We claim:

1. A compound having the general formula

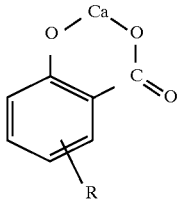

wherein R is selected from the group consisting of a linear alkyl containing 12 to 40 carbon atoms and a branched alkyl containing 9 to 24 carbon atoms.

2. A compound according to claim 1 wherein R is a linear alkyl containing 12 to 40 carbon atoms.

3. A compound according to claim 1 wherein R is a branched alkyl containing 9 to 24 carbon atoms.

* * * * *